US005839235A

United States Patent [19]

Sorkin

[11] Patent Number: 5,839,235

[45] Date of Patent: Nov. 24, 1998

[54] CORROSION PROTECTION TUBE FOR A POST-TENSION ANCHOR SYSTEM

[76] Inventor: Felix L. Sorkin, P.O. Box 1503, Stafford, Tex. 77477

[21] Appl. No.: 914,989

[22] Filed: Aug. 20, 1997

[51] Int. Cl.[6] ..... E04C 5/08

[52] U.S. Cl. ..... 52/223.13; 52/223.14; 24/122.6

[58] Field of Search ..... 52/223.13, 223.14, 52/226, 228, 225, 230, 231; 24/122.6; 264/228

[56] References Cited

U.S. PATENT DOCUMENTS

| | | | |
|---|---|---|---|
| 4,000,623 | 1/1977 | Meardi | 52/223.13 X |
| 4,114,242 | 9/1978 | Luthi | 52/223.13 |
| 4,348,844 | 9/1982 | Schupack et al. | 52/223.13 |
| 4,363,462 | 12/1982 | Wlodkowski et al. | 52/223.13 X |
| 4,616,458 | 10/1986 | Davis et al. | 52/223.13 |
| 4,631,883 | 12/1986 | Harris et al. | 52/223.14 |
| 4,718,209 | 1/1988 | Hansen et al. | 52/223.13 |
| 4,773,198 | 9/1988 | Reinhardt . | |
| 4,821,474 | 4/1989 | Rodriguez . | |
| 4,878,327 | 11/1989 | Nutzel et al. . | |
| 4,918,887 | 4/1990 | Davis et al. . | |
| 5,024,032 | 6/1991 | Rodriguez | 52/223.13 |
| 5,072,558 | 12/1991 | Sorkin et al. . | |
| 5,079,879 | 1/1992 | Rodrigluez . | |
| 5,271,199 | 12/1993 | Northern . | |
| 5,347,777 | 9/1994 | Sudduth | 52/223.13 |
| 5,479,671 | 1/1996 | Stubler et al. . | |
| 5,630,301 | 5/1997 | Sieg | 52/223.13 |
| 5,689,923 | 11/1997 | Winkeljann et al. | 52/223.13 |
| 5,701,707 | 12/1997 | Sorkin | 52/223.13 |

OTHER PUBLICATIONS

VSL Corporation, VSL Post–Tensioning Systems, Mar. 1994, pp. 24–31.

*Primary Examiner*—Lanna Mai
*Attorney, Agent, or Firm*—Harrison & Egbert

[57] ABSTRACT

A post-tension anchor system including an encapsulated anchor having a trumpet portion extending outwardly therefrom, a tendon affixed to the encapsulated anchor and extending through the trumpet portion, and a tubular body affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

18 Claims, 4 Drawing Sheets

CORROSION PROTECTION TUBE FOR A POST-TENSION ANCHOR SYSTEM

TECHNICAL FIELD

The present invention relates to post-tensioning systems. More particularly, the present invention relates to encapsulated anchor systems which serve to maintain the tendon of the post-tension system in a corrosion resistant condition. More specifically, the present invention relates to corrosion protection tubes as used in conjunction with encapsulated anchors for such post-tension anchor systems.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them.

When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the anchorage systems is the inability to effectively prevent liquid intrusion into the area of the unsheathed portion of the tendon. Normally, the unsheathed portion will extend outwardly, for a distance, from the anchor in the direction toward the dead end anchor.

In normal practice, a liquid-tight tubular member is placed onto an end of the anchor so as to cover the unsheathed portion of the tendon. The tubular member slides onto and over the trumpet portion of the encapsulated anchor so as to be frictionally engaged with the trumpet portion of the anchor. The opposite end of the tubular member will include a seal which establishes a generally liquid-tight connection with the sheathed portion of the tendon.

Unfortunately, various experiments with such systems have indicated that such "frictional engagement" between the liquid-tight tubular member and the trumpet portion of the anchor is inadequate for preventing liquid intrusion to the unsheathed portion of the tendon. In common practice, workers at the construction site will not attach the tubular member to the trumpet portion of the anchor in a suitable manner. As such, liquid will eventually migrate through the connection between the trumpet portion of the anchor and the end of the tubular member. In other circumstances, because of the stresses placed upon the tendon, the tubular member will become disengaged from the end of the anchor. In still other circumstances, workers will step on the tubular member during the installation of the anchorages such that the tubular member becomes dislodged from the trumpet portion of the anchor. In all of these circumstances, the "frictional engagement" between the tubular member and the trumpet portion of the anchor provides an inadequate connection.

It is an object of the present invention to provide a corrosion protection tube for a post-tension anchorage system that provides a positive connection between the corrosion protection tube and the trumpet portion of the encapsulated anchor.

It is another object of the present invention to provide a corrosion protection tube which provides an ability to easily visually inspect the connection between the tube and the anchor.

It is a further object of the present invention to provide a corrosion protection tube which will remain connected to the trumpet portion of the anchor despite various forces placed upon the corrosion protection tube.

It is still another object of the present invention to provide a corrosion protection tube which minimizes the space between the corrosion protection tube and the jacket of the tendon.

It is still a further object of the present invention to provide a corrosion protection tube which is easy to install, easy to manufacture, and relatively inexpensive.

These and other objects and advantages of the present invention will become apparent from a reading of the attached specification and appended claims.

SUMMARY OF THE INVENTION

The present invention is a corrosion protection tube for connection to a trumpet portion of an encapsulated anchor of a post-tension anchor system which comprises a tubular body having a notch extending therearound so as to establish a snap-fit engagement with a protrusion extending from the trumpet portion when the tubular body is attached to the trumpet portion. In particular, the notch is formed so as to be indented inwardly of the exterior surface of the tubular body. The protrusion extends inwardly of the trumpet portion so as to engage the notch when the tubular body is placed into the interior of the trumpet portion. The tubular body is tapered at an end so as to have a wide diameter proximal the notch and a narrow diameter distal the notch. The narrow diameter of the tubular body is located at the end position within the trumpet portion.

In the present invention, a collar is formed on the tubular body so as to extend outwardly of the exterior surface of the tubular body. The collar is positioned on a side of the notch opposite the end of the tubular body within the trumpet portion. The collar will have a diameter greater than the diameter of the opening of the trumpet portion. The collar will abut this end of the trumpet portion when the tubular body is in engagement with the trumpet portion.

In the present invention, a seal is affixed to an end of the tubular body opposite the trumpet portion. The seal serves to form a generally liquid-tight seal between the tubular body and the tendon of the post-tension anchor system. Specifically, the seal is an elastomeric seal having an interior surface abutting an outwardly extending edge on the tubular body. The elastomeric seal has a portion extending over the end of the tubular body and into the interior of the tubular body. The elastomeric seal will be in surface-to-surface contact with the sheathed portion of the tendon so as to establish a liquid-tight seal therewith.

DETAILED DESCRIPTION OF THE INVENTION

Figure 1:
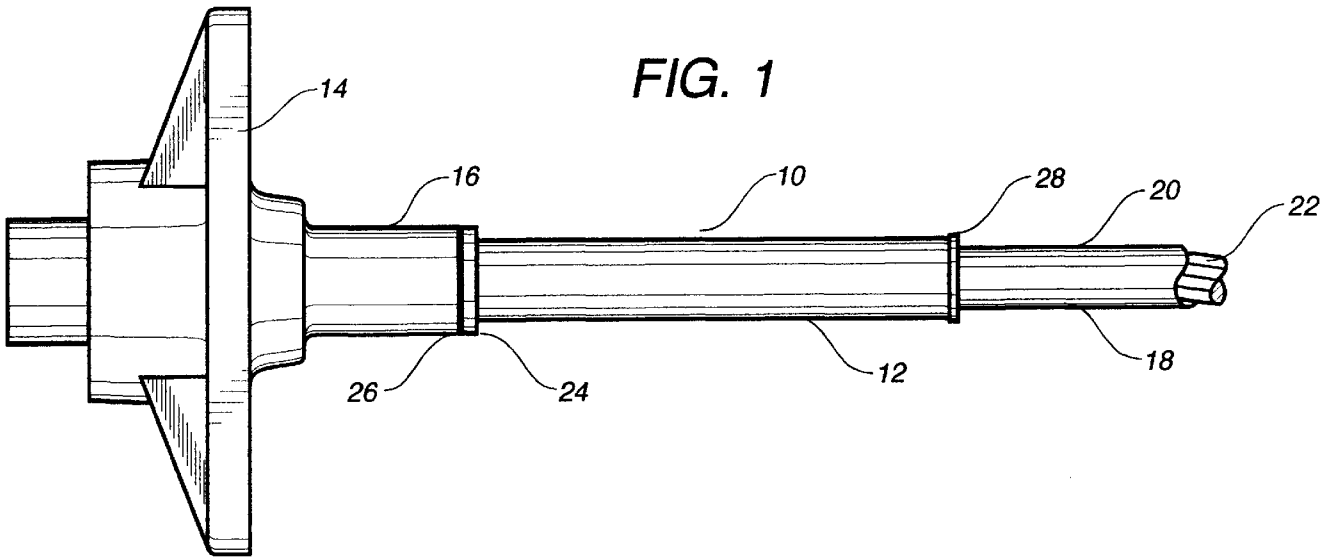
FIG. 1 is a plan view showing the post-tension system of the present invention.

Referring to FIG. 1, there is shown at 10 the post-tension anchor system employing the corrosion protection tube 12 of the present invention. The post-tension system 10 includes an encapsulated anchor 14 having a trumpet portion 16, the corrosion protection tube 12, and a tendon 18. The tendon 18 is illustrated so as to show a sheathed portion 20 and an unsheathed portion 22. In normal use, however, the sheathed portion 20 will extend over this unsheathed portion 22.

Referring to FIG. 1, it can be seen that an end of the corrosion protection tube 12 resides within the interior of the trumpet portion 16 of the encapsulated anchor 14. The corrosion protection tube 12 is formed of a liquid-impermeable polymeric material. The corrosion protection tube 12 includes a collar 24 adjacent to the end 26 of the trumpet portion 16. The corrosion protection tube 12 also includes a seal 28 at the end opposite the trumpet portion 16. The seal 28 serves to form a liquid-tight seal between the sheathed portion 20 of the tendon 18 and the corrosion protection tube 12. In FIG. 1, the encapsulated anchor 14 and the tendon 18 are of known construction.

Figure 2:
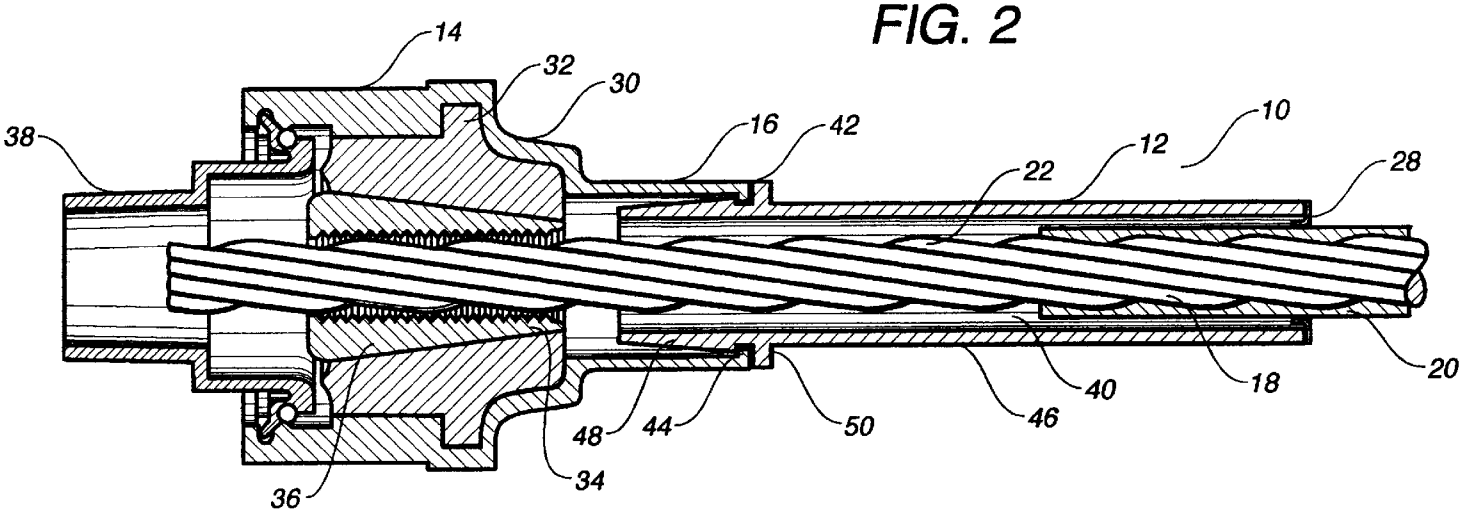
FIG. 2 is a side cross-sectional view of the post-tension system of the present invention.

FIG. 2 shows the manner in which the post-tension system 10 is assembled. In particular, in FIG. 2, it can be seen that the encapsulated anchor 14 includes a polymeric encapsulation 30 which generally surrounds the steel anchor 32. The anchor 32 will have an interior area 34 which receives the unsheathed portion 22 of the tendon 18. A plurality of wedges 36 serve to rigidly affixed the unsheathed portion 22 of the tendon 18 within the interior opening 34 of the anchor 32. A cap 38 is affixed to the end of the anchor 14 so as to seal the unsheathed portion 22 of the tendon 18. As can be seen, the unsheathed portion 22 of the tendon 18 will extend through the interior of the trumpet portion 16 and through the interior of the corrosion protection tube 12. The sheathed portion 20 of the tendon 18 will extend into the interior of the corrosion protection tube 12. Seal 28 is affixed to an end of the corrosion protection tube 12 so as to establish a liquid-tight seal between the exterior surface of the sheathed portion 20 of the tendon 18 and the corrosion protection tube 12. Suitable corrosion-resistant materials, such as grease, can be inserted into the interior 40 of the corrosion protection tube 12 and the trumpet portion 16 so as to resist the intrusion of water and oxygen to the unsheathed portion 22 of the tendon 18.

In FIG. 2, it can be seen that the trumpet portion 16 has a protrusion 42 extending inwardly from an end of the trumpet portion 16. The corrosion protection tube 12 has a notch 44 which extends around. It can be seen that the protrusion 42 is in snap-fit engagement with the notch 44. The notch 44 is indented inwardly of the exterior surface 46 of the corrosion protection tube 12. The protrusion 42 is an annular surface which is formed on the end of the trumpet portion 16.

The corrosion protection tube 12 has a tapered area 48 which will extend on the interior of the trumpet portion 16. The tapered area 48 has a wide diameter proximal to notch 44 and a narrow diameter at the end of the corrosion protection tube 12 within the trumpet portion 16. This tapered end area facilitates the installation of the corrosion protection tube 12 within the trumpet portion 16. In normal practice, the tapered area 48 can be inserted into the opening at the end of the trumpet portion 16. The corrosion protection tube 12 is pushed into the interior of the trumpet portion 16 until the protrusion 42 engages the notch 44. When the positive snap-fit engagement is achieved, the corrosion protection tube 12 will reside in liquid-tight engagement with the trumpet portion 16.

So as to facilitate the installation of the corrosion protection tube 12, a collar 50 is formed annularly around the exterior surface 46 of the corrosion protection tube 12. It can be seen that the collar 50 is in a side of the notch 44 opposite the tapered area 48. The collar 50 will have a diameter greater than the opening at the end of the trumpet portion 16.

The collar 50 facilitates the installation of the corrosion protection tube 12 in various manners. First, and foremost, the collar 50 provides a surface that can be easily gripped by a worker during the installation of the tube 12 into the trumpet portion 16. Secondly, when the tube 12 is fully installed into the trumpet portion 16, the collar 50 will reside in close proximity to the end of the trumpet portion 16. As such, the collar 50 will facilitate the easy inspection of the installation of the tube 12 within the trumpet portion 16. If the collar 50 is not in close proximity to the end of the trumpet portion 16, then an inspector can easily see that the tube has not been properly installed. Finally, the collar portion 50 will provide an additional surface which serves to prevent liquid intrusion into the interior of the tube 12.

It is important to note that the corrosion protection tube of the present invention must be manufactured by injection molding techniques. In prior art practice, the corrosion protection tube 12 was formed by simple extrusion and cutting. This is a relatively simple process that can be carried out in an easy and expeditious manner. However, with the formation of the notch 44 and the collar 50, along with the formation of the tapered area 48, it is necessary that the corrosion protection tube 12 be formed by injection molding. Although the corrosion protection tube 12 of the present invention requires a more expensive process to produce, it is felt that the need for complete corrosion resistance in the post-tension anchor system justifies the extra cost.

Figure 3:
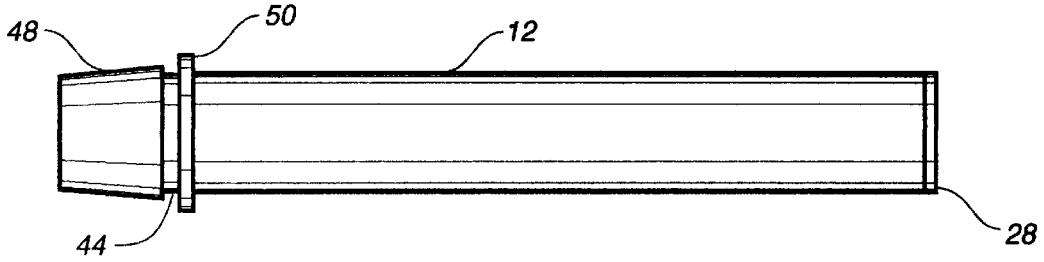
FIG. 3 is an isolated view of the corrosion protection tube of the present invention.

FIG. 3 shows the corrosion protection tube 12 as isolated from the anchor 14. As can be seen in FIG. 3, the corrosion protection tube 12 is a tubular member having a tapered area 48, a notch 44, and a collar 50. The seal 28 is affixed to the end of the corrosion protection tube 12 opposite the notch 44.

Figure 4:
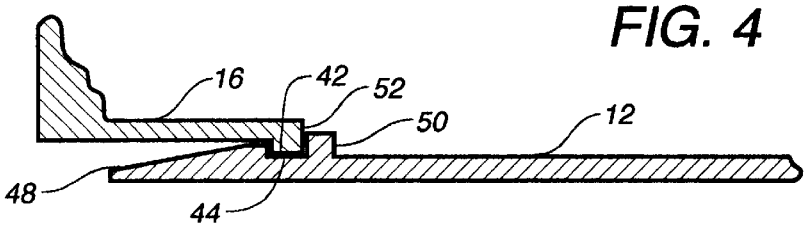
FIG. 4 is a detailed isolated view showing the manner of connection between the corrosion protection tube and the trumpet portion of the anchor.

FIG. 4 is an isolated view showing the manner in which the notch 44 of the corrosion protection tube 12 engages the inwardly extending protrusion 42 of the trumpet portion 16. As can be seen in FIG. 4, the tapered area 48 of the corrosion protection tube 12 extends into the interior of the trumpet portion 16. When the tapered area 48 has been inserted a proper distance, the inwardly extending protrusion 42 will "snap-fit" into the notch 44. Collar 50 will reside against the end surface 52 of the trumpet portion 16. In FIG. 4, it can be seen that the notch 44 is a generally semi-rectangular notch. The inwardly extending protrusion 42 has a shape which matches the shape of the notch 44.

Figure 5:
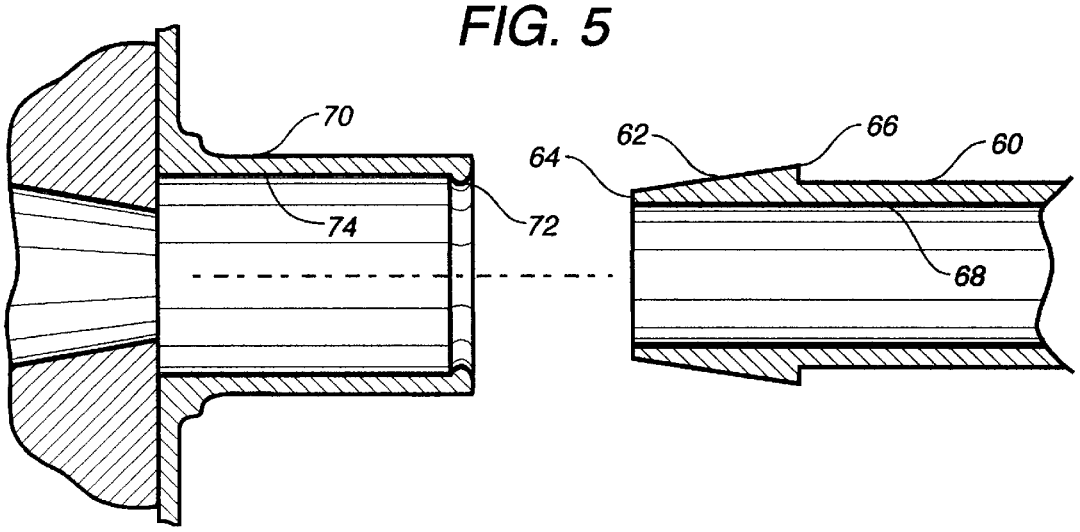
FIG. 5 is a cross-sectional illustration of the simplest form of the present invention.

FIG. 5 shows a simpler form of the present invention in which the collar 50 has been omitted from the construction of the corrosion protection tube. In FIG. 5, it can be seen that a corrosion protection tube 60 has a tapered end 62 formed at end 64 of the corrosion protection tube 60. An abutment surface 66 will reside at the wide end of the tapered portion 62. The corrosion protection tube 60 has a tendon-receiving interior 68.

The trumpet portion 70 includes an inwardly extending protrusion 72. As with the previous embodiment, the tapered portion 62 will extend toward the interior 74 of the trumpet portion 70 until the inwardly extending protrusion 72 snap-fits against the abutment surface 66 on the corrosion protection tube 60. As such, a positive snap-fit engagement is achieved between the corrosion protection tube 60 and the trumpet portion 70.

Figure 6:
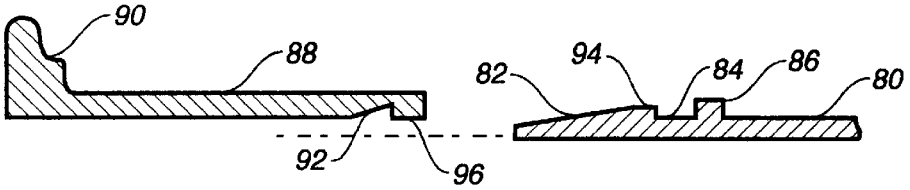
FIG. 6 is a detailed view of the connection of an alternative embodiment of the present invention.

FIG. 6 shows an alternative form of the present invention. In FIG. 6, it can be seen that the corrosion protection tube 80 has an arrow-shaped tapered end 82. A generally rectangular notch 84 is formed at the wide end of the tapered portion 82. Collar 86 is placed on the side of the notch 84 opposite the tapered portion 82. The trumpet portion 88 of the anchor 90 includes a notch 92 of triangular cross-section formed in the surface of the trumpet portion 88. When the corrosion protection tube 80 is installed into the interior of the trumpet portion 88, the wide end 94 of the tapered portion 82 of the corrosion protection tube 80 will be "snap-fitted" within the triangular notch 92 of the trumpet portion 88. Simultaneously, the generally rectangular area 96 of the trumpet portion 88 will reside within the rectangular notch 84 on the corrosion protection tube 80. As such, FIG. 6 shows a dual form of connection between the corrosion protection tube 80 and the trumpet portion 88.

Figure 7:
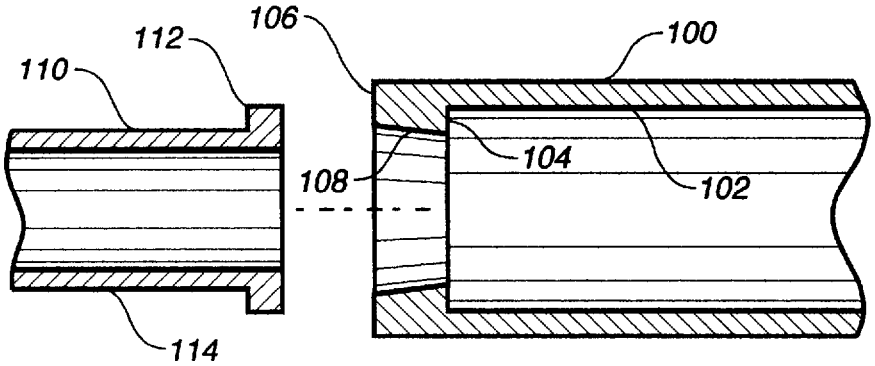
FIG. 7 is a cross-sectional exploded view of a second alternative form of the present invention.

FIG. 7 shows a further alternative embodiment of the system of the present invention. In FIG. 7, it can be seen that the corrosion protection tube 100 has an interior surface 102 with an abutment surface 104 formed adjacent end 106. A tapered section 108 extends from the end 106 to the abutment surface 104. The tapered portion 108 extends such that a narrow diameter resides adjacent to the abutment surface 104 and a wide diameter is located adjacent to the end 106. The trumpet portion 110 has a protrusion 112 which extends outwardly of the exterior surface 114 of trumpet portion 110. In the embodiment of FIG. 7, there are no inwardly extending protrusions on the trumpet portion 110.

Figure 8:
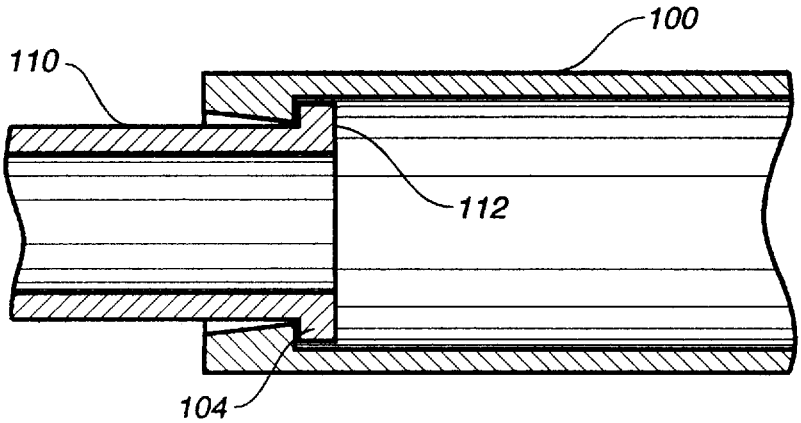
FIG. 8 is the assembled view of the second alternative embodiment of the present invention as shown in FIG. 7.

FIG. 8 shows the manner in which the trumpet portion 110 is installed within the interior of the corrosion protection tube 100. As can be seen, the outwardly extending protrusion 112 will pass along the tapered portion 108 until the outwardly extending protrusion 112 will reside against the abutment surface 104 of the corrosion protection tube 100. In the form of the invention illustrated in FIGS. 7 and 8, the corrosion protection tube 100 will have a greater diameter than the trumpet portion 110. However, the embodiments of FIGS. 7 and 8 show still a further form in which the corrosion protection tube 100 can be "snap-fitted" onto the trumpet portion 110.

Figure 9:
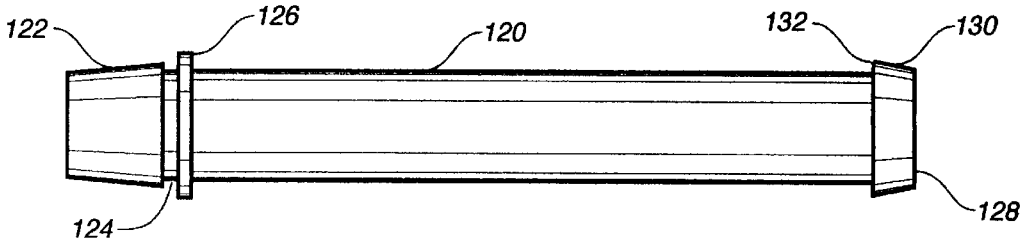
FIG. 9 is an isolated view of a corrosion protection tube showing the manner of connecting the seal.

FIG. 9 shows another form of the corrosion protection tube 120 which has a tapered end 122, an inwardly extending notch 124 and a collar 126, in the manner of the embodiments of FIGS. 1–4. However, at the opposite end 128 is a area for the receipt of an elastomeric seal. Specifically, the area 130 has an outwardly extending edge 132 which extends annularly around the corrosion protection tube 120. The tapered portion 130 will extend such that the narrow end of the tapered portion 130 is adjacent the end 128 of the tube 120.

Figure 10:
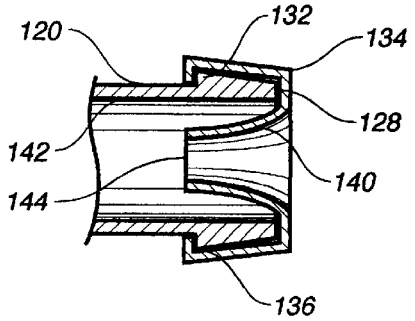
FIG. 10 is a cross-sectional view showing the configuration of the seal at the end of the tube.

FIG. 10 shows the elastomeric seal 134 as affixed onto the corrosion protection tube 120. It can be seen that the elastomeric seal 134 has an interior surface 136 which engages the outwardly extending edge 132. The elastomeric seal 134 will extend along the surface 130 and over the end 128 so as to have a portion 140 extending into the interior 142 of the corrosion protection tube 120. As such, the portion 140 serves as a surface for establishing the liquid-tight seal with the sheathed portion of the tendon extending therethrough. Opening 144 allows the tendon to extend into the interior 142 of the corrosion protection tube 120.

Figure 11:
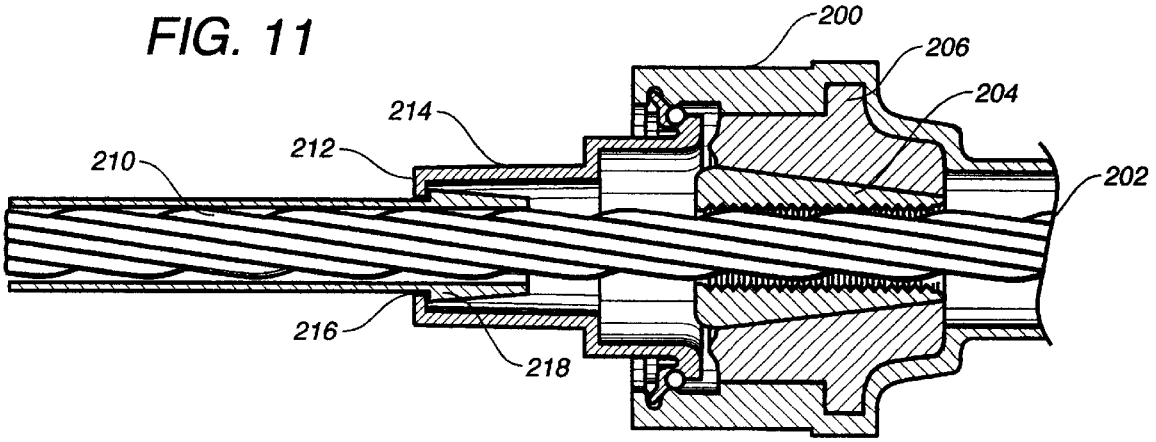
FIG. 11 is a cross-sectional view showing the corrosion protection tube of the present invention as used with an intermediate anchorage of a post-tension system.

FIG. 11 shows the present invention as connected to an intermediate anchorage 200 of a tendon-tensioning anchor system. The intermediate anchorage 200 is an encapsulated anchor having a tendon 202 extending therethrough. Suitable wedges 204 serve to affix the tendon 202 within the interior of the steel anchor 206. An open cap 208 is affixed to the encapsulation 200 and extends outwardly therefrom. The corrosion protection tube 210 is affixed onto the cap 208 at the end 212 of a tubular section 214 of the cap 208. As can be seen, the corrosion protection tube 210 has a configuration similar to the previous embodiments. The end 212 of the tubular section 214 includes an inwardly extending annular surface 216 which is in snap-fit engagement with the abutment surface 218 of the end of the corrosion protection tube 210. As such, in this manner, the corrosion protection tube 210 can be used in conjunction with an intermediate anchorage.

The present invention achieves significant advantages over the prior friction-type of engagement systems. First, and foremost, the corrosion protection tube of the present invention establishes a "positive connection" between the anchor and the tube. This "snap-fit" engagement assures that positive liquid-tight contact is established between the tube and the anchor. Inspection of the installation can be easily achieved from the use of the collar on the corrosion protection tube. The form of connection is resistive of all forces which would cause the tube to become dislodged from the tapered portion of the anchor. In fact, the form of connection between the corrosion protection tube and the anchor can withstand the weight of a 250 pound worker without dislodging.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A corrosion protection tube for connection to a trumpet portion of an encapsulated anchor of a post-tension anchor system comprising:

a tubular body have a notch means extending therearound, said notch means for snap-fit engagement with a protrusion extending from the trumpet portion when said tubular body is attached on the trumpet portion, said tubular body body having open ends and a closed interior; and a collar formed on said tubular body so as to extend outwardly of an exterior surface of said tubular body adjacent to said notch means.

2. The tube of claim 1, said notch means comprising a notch formed so as to be indented inwardly of said exterior surface.

3. The tube of claim 2, said end being tapered so as to have a wide diameter proximal said notch and a narrow diameter distal said notch.

4. The tube of claim 3, said tubular body having an end at said narrow diameter.

5. The tube of claim 1, said tubular body having an end for placement interior of the trumpet portion, said collar positioned on a side of said notch opposite said end.

6. The tube of claim 1, further comprising:

a seal means affixed to an end of said tubular body distal said notch means, said seal means for forming a generally liquid-tight seal between said tubular body and a tendon of the post-tension anchor system.

7. The tube of claim 6, said tubular body having an outwardly extending edge adjacent said end of said tubular body, said seal means further comprising:

an elastomeric seal having an interior surface abutting said outwardly extending edge, said elastomeric seal having a portion extending over said end and extending into an interior of said tubular body.

8. The tube of claim 1, said notch means comprising an abutment surface formed on an interior of said tubular body adjacent an end of said tubular body, said abutment surface engagable with a protrusion extending outwardly of an exterior surface of said trumpet portion.

9. A post-tension anchor system comprising:

an encapsulated anchor having a trumpet portion extending outwardly therefrom;

a tendon affixed to said encapsulated anchor and extending through said trumpet portion; and a tubular body affixed in snap-fit engagement with said trumpet portion so as to extend outwardly from said trumpet portion in axial alignment therewith, said tubular body extending around said tendon, said tubular body having a notch formed on an exterior surface thereof, said trumpet portion having an inwardly extending surface, said inwardly extending surface engaging said notch, said tubular body having open ends and a closed interior, said tubular body having one end extending into said trumpet portion, said one end being continuously tapered so as to have a wide end proximal said notch and a narrow end distal said notch.

10. The system of claim 9, said tubular body having a seal means at an end opposite said trumpet portion, said seal means for forming a generally liquid-tight seal with an exterior surface of said tendon.

11. The system of claim 10, said tubular body having an end extending into said trumpet portion, said tubular body having a collar extending therearound on a side of said notch opposite said end, said collar having a diameter greater than a diameter of said tubular body.

12. The system of claim 11, said collar being in abutment with an end of said trumpet portion.

13. The system of claim 9, said tubular body having a portion with an outer diameter less than an inner diameter of said trumpet portion, said portion of said tubular body being positioned within said trumpet portion in generally liquid-tight engagement therewith.

14. The system of claim 9, said tendon having a sheathed portion and an unsheathed portion, said unsheathed portion connected to said anchor and extending through said trumpet portion, said tubular body extending over said unsheathed portion so as to have an end overlying said sheathed portion of said tendon.

15. The system of claim 14, said tubular body having a seal means at an end overlying said sheathed portion, said seal means for forming a liquid-tight seal between said tubular body and said sheathed portion of said tendon.

16. The system of claim 15, said seal means comprising an elastomeric seal, said tubular body having an outwardly extending edge adjacent said end of said tubular body, said elastomeric seal having an interior surface engaging said outwardly extending edge, said elastomeric seal extending over said end of said tubular body and into an interior of said tubular body so as to be in surface-to-surface contact with said sheathed portion.

17. The system of claim 9, said encapsulated anchor being an intermediate anchorage of the post-tension anchor system, said encapsulated anchor having a tubular section extending outwardly therefrom on an end opposite said trumpet portion, said tubular section being in axial alignment with said trumpet portion, the system further comprising:

a tubular connection in snap-fit engagement with said tubular section so as to extend outwardly therefrom, said tendon extending through an interior of said tubular connector.

18. The system of claim 17, said tubular connector having an abutment edge formed thereon, said tubular section having an inwardly extending annular surface, said abutment edge engaging said annular surface, said tubular connector having a portion extending interior of said tubular section.

* * * * *